US005944138A

United States Patent [19]

Vollmer et al.

[11] Patent Number: 5,944,138

[45] Date of Patent: Aug. 31, 1999

[54] LEVELING SYSTEM FOR AERIAL PLATFORMS

[75] Inventors: Edwin L. Vollmer; Roger Leigh Burgoon; Bryan D. Player; R. Dustin Clevenger, all of St. Joseph, Mo.

[73] Assignee: Altec Industries, Inc., Birmingham, Ala.

[21] Appl. No.: 08/923,058

[22] Filed: Sep. 3, 1997

[51] Int. Cl.[6] ..... E04G 1/00

[52] U.S. Cl. ..... 182/2.1; 182/2.2

[58] Field of Search ..... 182/2.1, 2.3, 2.2, 182/2.7, 2.8, 2.9, 2.19, 2.4; 74/108; 474/158, 152, 155, 206

[56] References Cited

U.S. PATENT DOCUMENTS

| | | | |
|---|---|---|---|
| 3,590,948 | 7/1971 | Milner, Jr. . | |
| 3,791,484 | 2/1974 | Harrison . | |
| 3,835,957 | 9/1974 | Richards . | |
| 3,860,088 | 1/1975 | Gellatly | 182/2.1 |
| 3,893,540 | 7/1975 | Beucher . | |
| 4,410,049 | 10/1983 | Molin . | |
| 4,553,632 | 11/1985 | Griffiths . | |
| 4,697,468 | 10/1987 | Bergstrand | 74/108 X |
| 4,799,573 | 1/1989 | Simnovec et al. . | |
| 4,858,723 | 8/1989 | Holmes et al. . | |
| 5,016,731 | 5/1991 | Holmes | 182/2.1 |

*Primary Examiner*—Daniel P. Stodola
*Assistant Examiner*—Hugh B. Thompson
*Attorney, Agent, or Firm*—Shook, Hardy & Bacon LLP

[57] ABSTRACT

A system for leveling a personnel carrying platform mounted on the end of an elongated vehicle mounted boom. A pendulum controlled hydraulic valve controls the application of fluid pressure to a pair of cylinders equipped on their ends with a series of links extending along a drum connected to the platform mounting pin. When the platform deviates from a level position, one of the cylinders is retracted to turn the platform mounting pin in a direction to correct the deviation. An interlock valve disables the platform leveling system unless the boom is being moved. A manual override valve allows the platform to be tilted for storage or other reasons.

9 Claims, 5 Drawing Sheets

LEVELING SYSTEM FOR AERIAL PLATFORMS

FIELD OF THE INVENTION

This invention relates generally to aerial devices and more particularly to a leveling system which serves to maintain an aerial platform in a level position during operation of the machine.

BACKGROUND OF THE INVENTION

Vehicle mounted aerial devices are widely used to perform work at elevated locations such as on utility poles and overhead utility lines. The aerial device includes a boom which is mounted for rotation in a vehicle bed and which carries on its upper end a platform that is typically a bucket or basket. Multiple section booms are common, and they may be articulating or telescoping booms. Articulating boom assemblies including a lower boom having a knuckle joint connection with an upper boom which carries the platform. The booms can both be pivoted up and down by hydraulic cylinders in order to properly position workers carried in the bucket. Telescoping boom assemblies have boom sections that telescopically extend and retract to position the platform as desired.

In both types of machines, it is necessary to maintain the floor of the platform in a level horizontal position as the boom pivots up and down. Various types of platform leveling systems have been developed to perform the leveling function. Existing leveling systems are for the most part either mechanical systems employing mechanical linkages or hydraulic systems making use of hydraulic cylinders in a master/slave relationship.

Prevalent mechanical leveling systems include parallelogram linkage systems and chain or cable systems. In the parallelogram linkage system, a link is pinned to the platform and to the turntable or base. The link is parallel to the boom but is pinned at locations offset from the boom pivot connections to the turntable and platform. The pin locations and the link and boom form a parallelogram geometry that keeps the platform floor horizontal as the boom is raised and lowered. While this type of arrangement is simple and functions well at small boom angles, it has a significant disadvantage in that the boom articulation is limited. When the boom is pivoted beyond 90° (straight up), the boom and link are subjected to geometrically increasing column loads, and large stresses are applied to the pivot pins. The pivot points on the platform pass one another at some position beyond 90°, and the system then collapses.

The chain or cable systems are commonly used when the boom assembly is an articulating structure having two or more booms. A chain or cable is extended through the booms in a continuous loop. One end of the chain or cable is fixed to the turntable. The chain or cable extends within the lower boom and is drawn around a sheave or sprocket located at the pinned connection between the upper and lower booms. The chain or cable then extends within the upper boom and around a sheave or sprocket fixed to the platform pin on which the platform is carried. The chain or cable is then extended back down around the sheave or sprocket located between the two booms and is extended through the lower boom and secured to the turntable. The continuous loop that is made by the chain or cable provides a mechanism that keeps the platform floor in the same plane as the turntable as the booms are raised or lowered.

Although this system is also relatively simple, it is subject to several mechanical problems. The chain or cable can stretch under load, as can sections of booms that are insulated. Stretching of the cable or chain can create a situation where the platform "sags under load" and creates a "spongy" feel. The components are largely housed within the booms where access for maintenance is difficult. Also, load safety factor considerations require large boom cross-sections which increase the cost and weight of the machine. Cable systems are also subject to required mandatory scheduled replacement of parts and other significant maintenance requirements. If the platform leveling loads are large, the cables, chains, insulating rods, sheaves and sprockets must be unduly large to handle the loads.

Master/slave hydraulic leveling systems are used extensively on telescopic aerial devices. This type of leveling system makes use of two hydraulic cylinders, one of which serves as a master cylinder and the other of which serves as a slave cylinder. The master cylinder is connected at one end to the turntable and at the other end to the boom which pivots on the turntable. The slave cylinder is connected at one end to the tip portion of the boom assembly and at the other end to the platform. The two cylinders have fluid chambers that are equal in volume. The cylinders are hydraulically connected such that extension or retraction of the master cylinder, as occurs when the boom pivots up or down, causes the slave cylinder to extend or retract the same distance but in the opposite direction as the master cylinder. The geometry and the hydraulic circuitry maintains the platform floor in the same plane as the turntable as the boom is raised or lowered.

Hydraulic systems of this type are satisfactory when the angle of boom articulation is 120° or less. However, this limitation in the allowable articulation is a drawback in many applications. Also, the closed hydraulic loop is difficult to purge and difficult to maintain free of air infiltration which can cause operating problems.

All of these systems are characterized by components which are located at both ends of the boom and throughout the entire boom assembly. This results in assembly and maintenance difficulties and occupies space that can otherwise be used for other purposes.

SUMMARY OF THE INVENTION

The present invention is directed to an improved platform leveling system which eliminates many of the problems encountered with the leveling systems that have been used in the past.

One object of the invention is to provide a platform leveling system in which all of the operating components are at one location and all action of the system, other than supplying hydraulic power, takes place at that location. By situating the components at a single location, the assembly and maintenance requirements are greatly simplified, and most of the parts that are internal to the boom are eliminated so that the boom interior is available for other purposes.

Another object of the invention is to provide a platform leveling system which provides for a greater amount of boom articulation than is allowed by other systems. The present invention makes use of hydraulic cylinder actuation combined with a "walking link" type arrangement that cooperate to provide enhanced boom articulation. The cylinder and walking link arrangement is also more economical than rotary actuators and motor/gear box mechanisms, and cylinders are more positive in feel of operation because the "breakaway friction" is significantly less to provide smoother starts and stops. The operator is thus provided with a greater feeling of security than is the case with jerky or erratic motion associated with other types of actuators.

A further object of the invention is to provide a platform leveling system which is applicable to both articulating and telescoping boom assemblies and which is able to handle large platform leveling loads without the need for unduly large cables, chains, insulating rods, sheaves or sprockets.

Still another object of the invention is to provide a platform leveling system of the character described which is not subjected to chain or cable stretch that creates "sag under load" conditions. In addition, the rigidity of the leveling system of the present invention provides a more solid feel for the occupant of the platform in contrast to the "spongy" feel associated with many other types of systems.

Yet another object of the invention is to provide a platform leveling system of the character described which does not require mandatory scheduled replacement of parts, which requires no regularly scheduled maintenance other than inspection, and which does not require lubrication, adjustment or other maintenance practices commonly associated with chain or cable systems.

A still further object of the invention is to provide a platform leveling system which is enhanced in safety compared to other systems. In this respect, the platform leveling function is preferably interlocked with the boom operating functions. The leveling system thus cannot malfunction and inadvertently dump the workers out of the platform while the boom is stationery. If the boom is being moved and the platform starts to tilt due to a malfunction in the leveling system, the operator can simply discontinue boom operation and the leveling system is automatically disabled at the same time.

An additional object of the invention is to provide a platform leveling system that can be disabled to permit the platform to be tilted for cleaning or operator rescue.

In accordance with the invention, a pair of hydraulic cylinders are mounted to the tip portion of an aerial boom and carry flexibly connected links on their rod ends. The links wrap around a cylindrical drum that is connected with the horizontal platform pin on which the aerial platform is mounted. The links wrap around the drum in opposite directions and connect at their ends with levers that project radially from the drum.

A gravity sensing device includes a pendulum pivotally mounted on the platform and associated with a hydraulic valve that controls the application of hydraulic fluid to the cylinders. If the platform deviates from a level position, the pendulum remains vertical and the hydraulic valve it carries is shifted to direct fluid to and from the two cylinders. This causes one cylinder to extend and the other to retract by the same amount such that the drum and platform pin are turned in a direction to correct the out of level condition. When the platform has been returned to a level position, the valve discontinues fluid application to the cylinders.

BRIEF DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
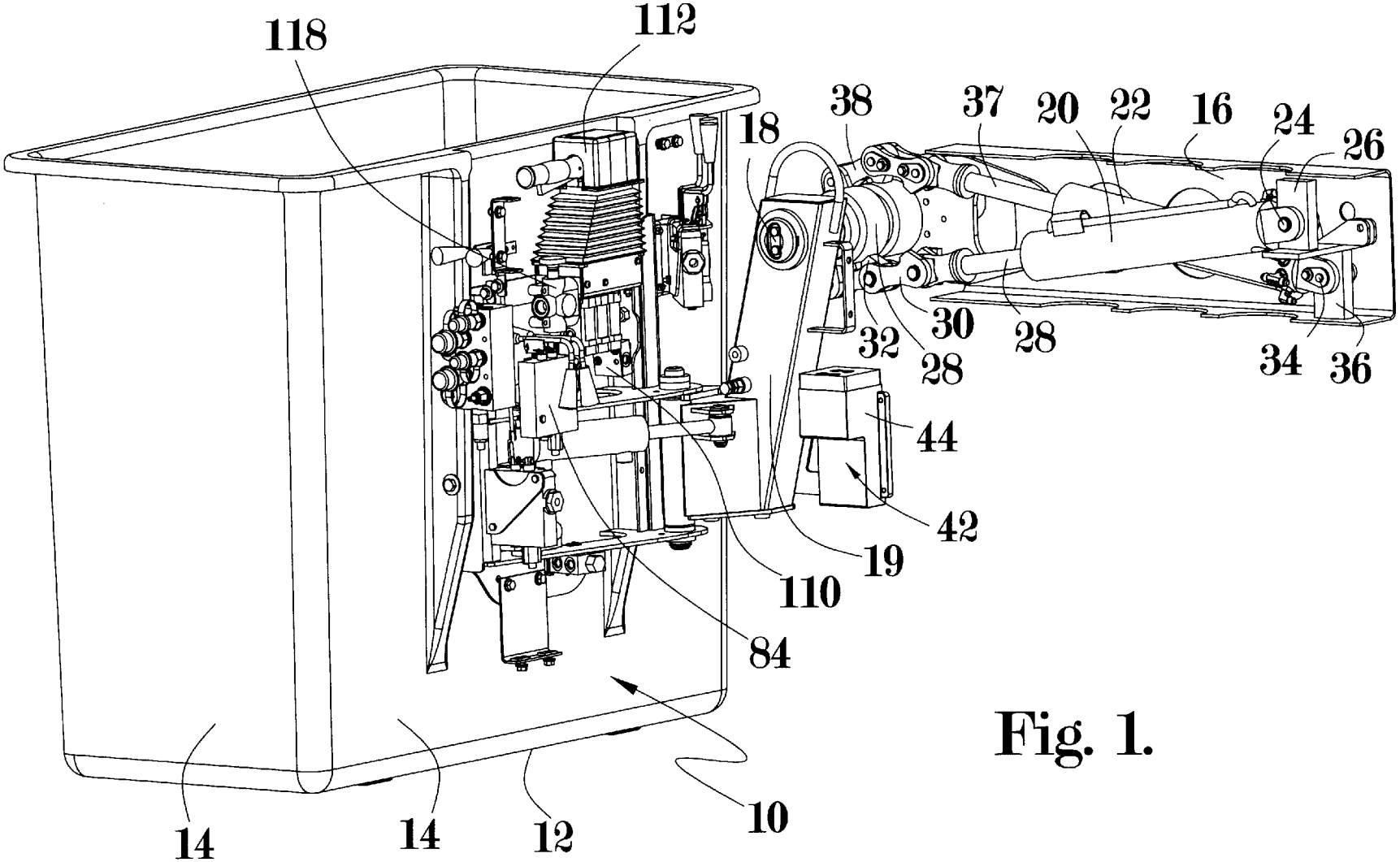
FIG. 1 is a perspective view of an aerial platform and the upper end portion of a boom on which the platform is carried, with a portion of the boom broken away to illustrate a pair of hydraulic cylinders and walking link arrangement forming part of a platform leveling system constructed according to the preferred embodiment of the present invention.

Referring now to the drawings in more detail and initially to FIG. 1, numeral 10 generally designates an aerial platform which is carried on an aerial device of the type disclosed in U.S. Pat. No. 4,602,462 which is incorporated by reference and to which reference may be made for a more detailed understanding of the machine as a whole. The platform 10 may take the form of a partial enclosure having a horizontal floor 12 on which workers stand and side and end walls 14 which confine the legs of workers. The platform 10 is open at the top so that workers can reach out of it to perform work on elevated equipment such as power transformers mounted on utility poles and on overhead utility lines.

The platform 10 is mounted on the upper tip portion of a boom assembly which may include one or more boom sections. The boom assembly is mounted for rotation in a vehicle bed. The tip portion of the boom assembly is located on the tip of an upper boom 16. A horizontal platform pin 18 is connected with the tip portion of boom 16 such that the pin 18 can rotate about a horizontal axis defined as the longitudinal center line of the platform pin. The platform pin 18 is rigidly secured to the upper end portion of a beam 19 which is secured at its lower end to the outside surface of one of the platform walls 14.

As the boom 16 moves upwardly and downwardly, the platform pin 18 is able to rotate relative to the boom tip so that the floor 12 of the platform can remain level or horizontal at all boom positions. The present invention is directed to a system for positively maintaining a level position of the platform as the boom is raised and lowered.

Figure 2:
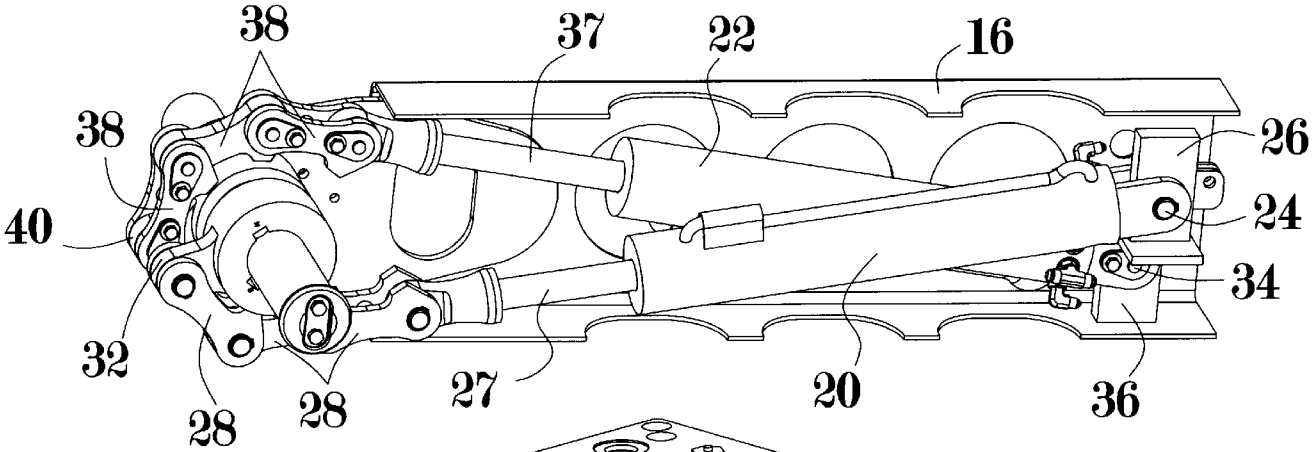
FIG. 2 is a fragmentary perspective view of the upper end portion of the boom showing the hydraulic cylinder and walking link arrangement.

The platform leveling system includes a pair of hydraulic cylinders 20 and 22 which are mounted within the boom 16 near its upper end portion. The base end of cylinder 20 is pinned at 24 to a mounting ear 26 fixed to the boom 16. Cylinder 20 extends forwardly and downwardly at an angle from the mounting ear 26 and has a piston rod 27 which carries on its end three links 28. The links 28 are pivotally connected end to end to allow the series of links to exhibit the flexibility necessary to assume both straight and curved or bent configurations. As best shown in FIG. 2, the links 28 extend partially around the bottom of a cylindrical drum 30 which is rigidly connected with the platform pin 18 and which turns with pin 18 about the horizontal platform pin axis. The end link 28 is pivotally connected with a short lever 32 which projects outwardly from drum 30 in a radial direction.

The other hydraulic cylinder 22 is pinned at 34 to another mounting ear 36 which is located below and to one side of ear 26. Cylinder 22 extends forwardly and upwardly from ear 36 and has a piston rod 37 which is connected at its end with three links 38. The links 38 are pivotally connected end to end and wrap generally around the upper portion of the cylindrical surface of the drum 30. The end link 38 is pinned to a short lever 40 (FIG. 2) which projects radially outwardly from drum 30 at a location parallel to and to one side of lever 32.

Figure 3:
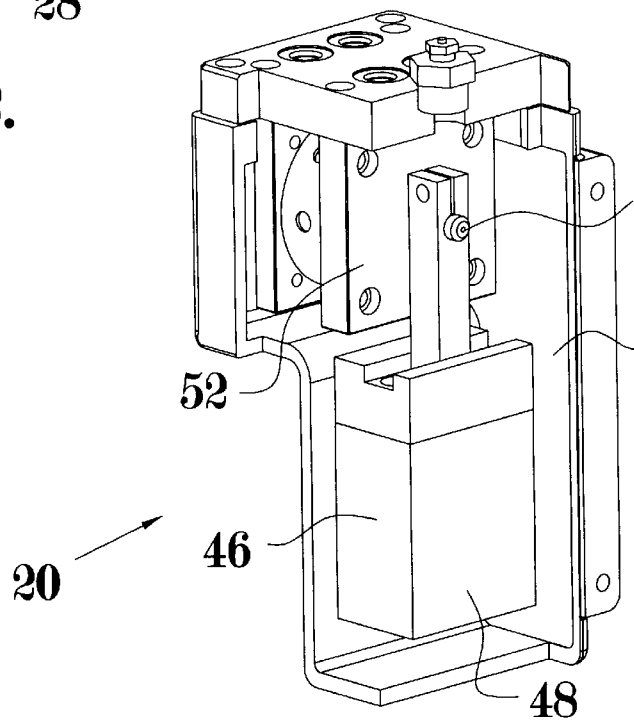
FIG. 3 is a perspective view of a gravity sensing device which forms part of the platform leveling system.

The cylinders 20 and 22 are controlled by a gravity operated level sensing device which is generally identified by numeral 42. As best shown in FIG. 1, the level sensing device 42 is contained within a housing 44 which is secured to the beam 19. With reference more particularly to FIG. 3, the level sensing device includes a pendulum 46 which is located within the housing 44 and which carries a weight 48 on its lower end. The upper end of the pendulum 46 is pinned at 50 to a housing 52 of a hydraulic valve. The pin 50 is horizontal and parallel to the axis of the platform pin 18, and it suspends the pendulum 46 within its housing 44 so that the pendulum can freely pivot with the pin 50, thus always maintaining a vertical orientation of the pendulum. When the valve housing 52 deviates rotationally from its normal position, the pin 50 turns relative to the housing 52.

Figure 4:
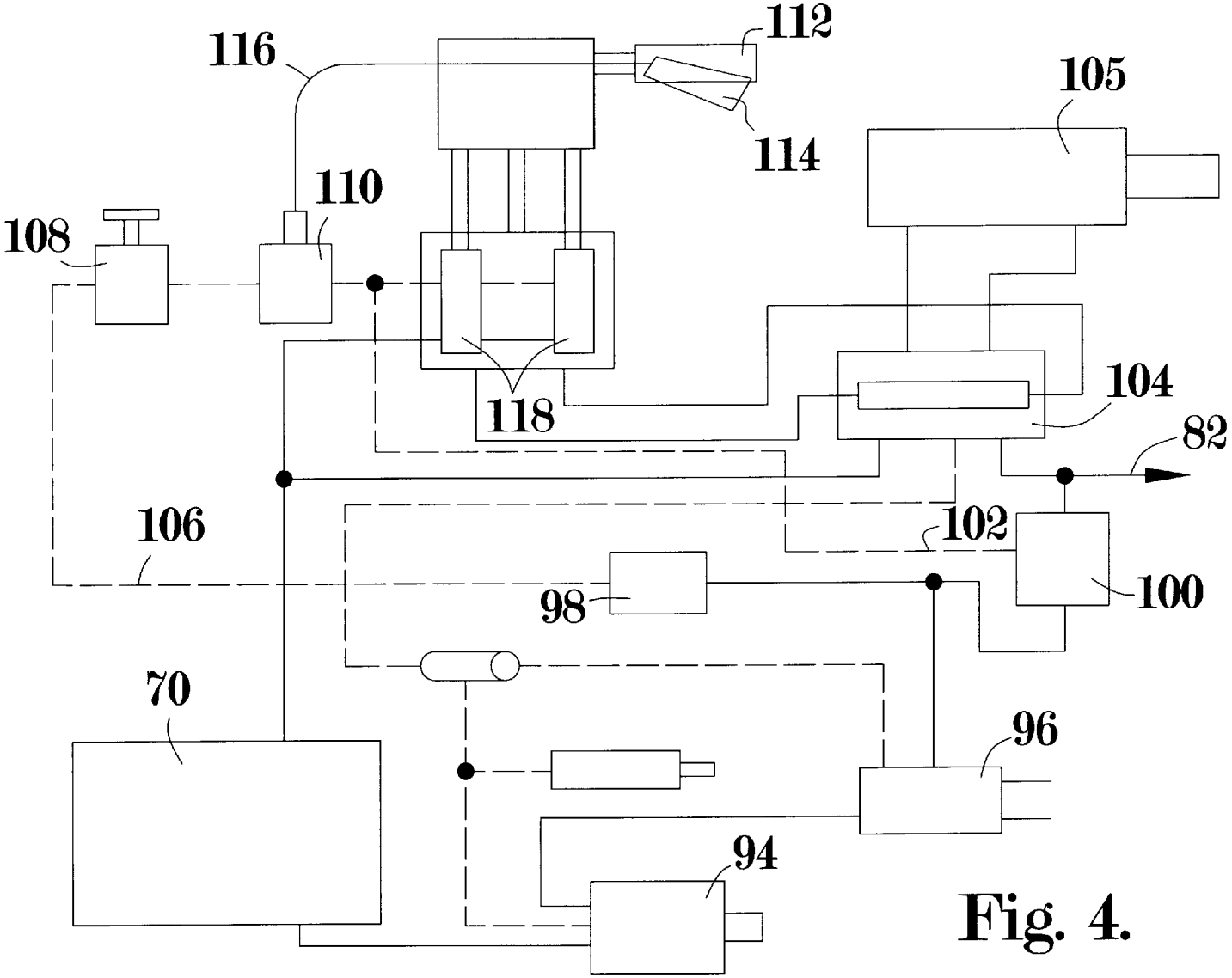
FIG. 4 is a schematic diagram of the hydraulic circuit for controlling functions of the aerial device.
Figure 5:
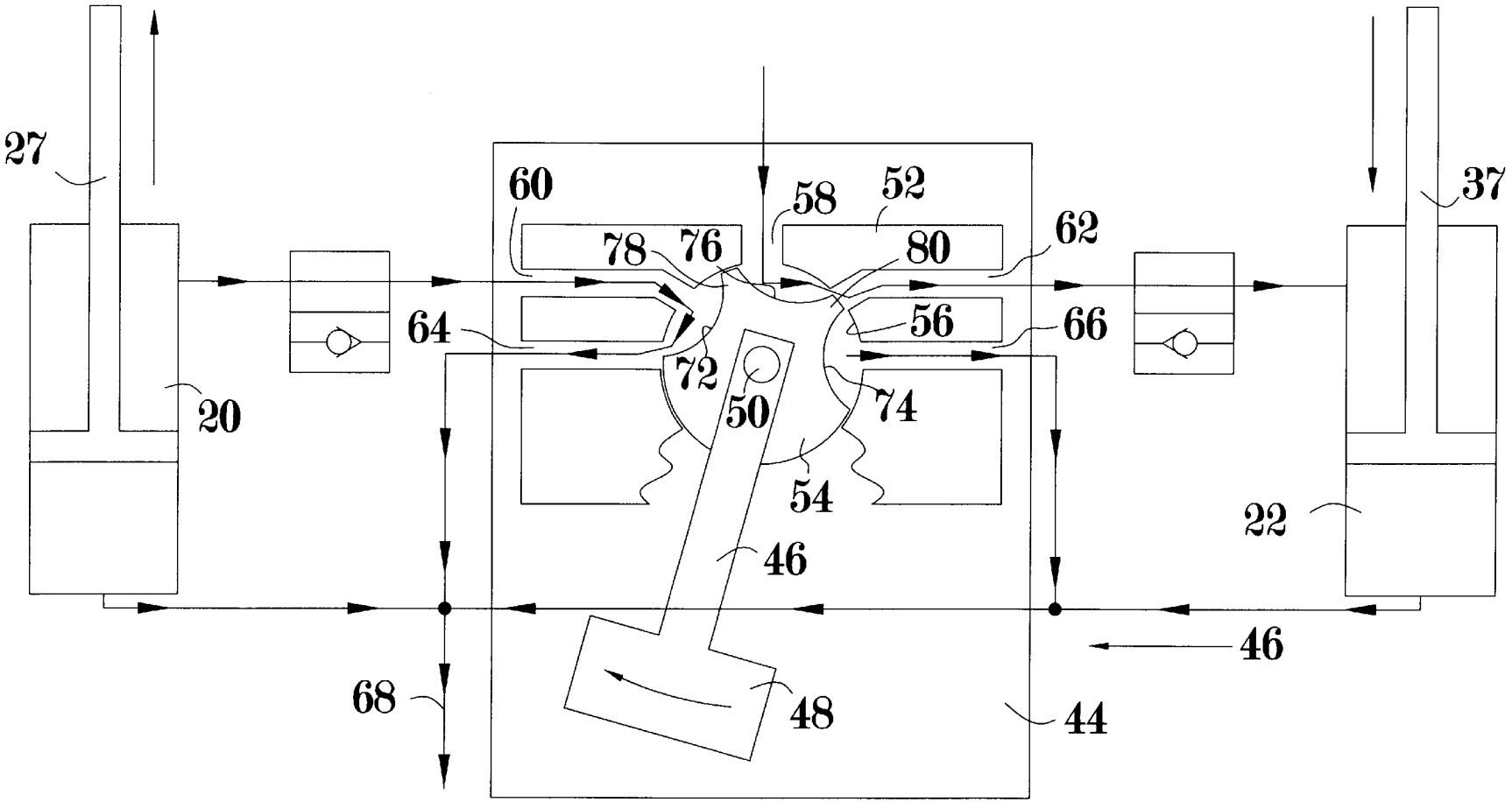
FIG. 5 is a diagrammatic view of the hydraulic circuit of the platform leveling system showing the flow of hydraulic fluid when the aerial platform is out of level.

As shown somewhat diagrammatically in FIG. 5, the hydraulic valve includes a valve element 54 which is secured to the pin 50 and is located within the housing 52. The valve element 54 is generally circular and operates within a circular chamber 56. The valve housing 52 is provided with a plurality of ports, including a pressure port 58 which supplies incoming fluid pressure to the valve. Additional ports 60 and 62 connect with the respective cylinders 20 and 22 adjacent to their rod ends. Another port 64 connects with the base end of cylinder 20. The final port 66 connects with the base end of the other cylinder 22. The base ends of both cylinders 20 and 22 and ports 64 and 66 are connected with a tank line 68. The tank line 68 in turn connects with a hydraulic reservoir 70 (see FIG. 4). The valve element 54 is provided on its periphery with arcuate notches 72 and 74 located on its opposite side portions. Another arcuate notch 76 is provided on the periphery of the top portion of the valve element 54. A finger 78 is formed between notches 72 and 76, and another finger 80 is formed between notches 74 and 76. The tips of the fingers 78 and 80 are adjacent to the wall of the valve chamber 56.

When the platform 10 is in a level position, the housing 44 of the level sensing device 42 has an upright position. Then, the fluid pressure which is applied through port 58 is confined to the portion of the valve chamber 56 formed within notch 76 because the fingers 78 and 80 block the pressure port 58 from the ports 60 and 62 leading to the cylinders 20 and 22. Ports 60 and 64 are connected with one another through the notch 72. Similarly, ports 62 and 66 are connected with one another through the notch 74.

If the platform deviates from a level position, the housing 44 deviates from its normal upright position while the pendulum 46 remains suspended in a vertical position. FIG. 5 shows the platform deviated in one direction from a level position. The relative rotation between the valve element 54 and the valve housing 52 displaces finger 80 from its normal position blocking flow between ports 58 and 62. These two ports are then connected through the notch 76 such that fluid pressure is applied through them to the rod end of cylinder 22. This causes cylinder 22 to retract its rod 37, thus causing the links 38 to pull lever 40. This rotates the drum 30 and the platform pin 18 until the platform floor 12 is again in a level position, at which time finger 80 blocks additional hydraulic pressure from port 58 to port 62. As the rod of cylinder 22 is retracting, the turning of drum 30 causes the rod 27 of cylinder 20 to extend as links 28 are pulled by lever 32 to additionally wrap around the underside of the drum. The fluid pressure in the rod end of cylinder 20 is relieved through port 60 and through notch 72 and port 64 to the tank line 68.

Figure 6:
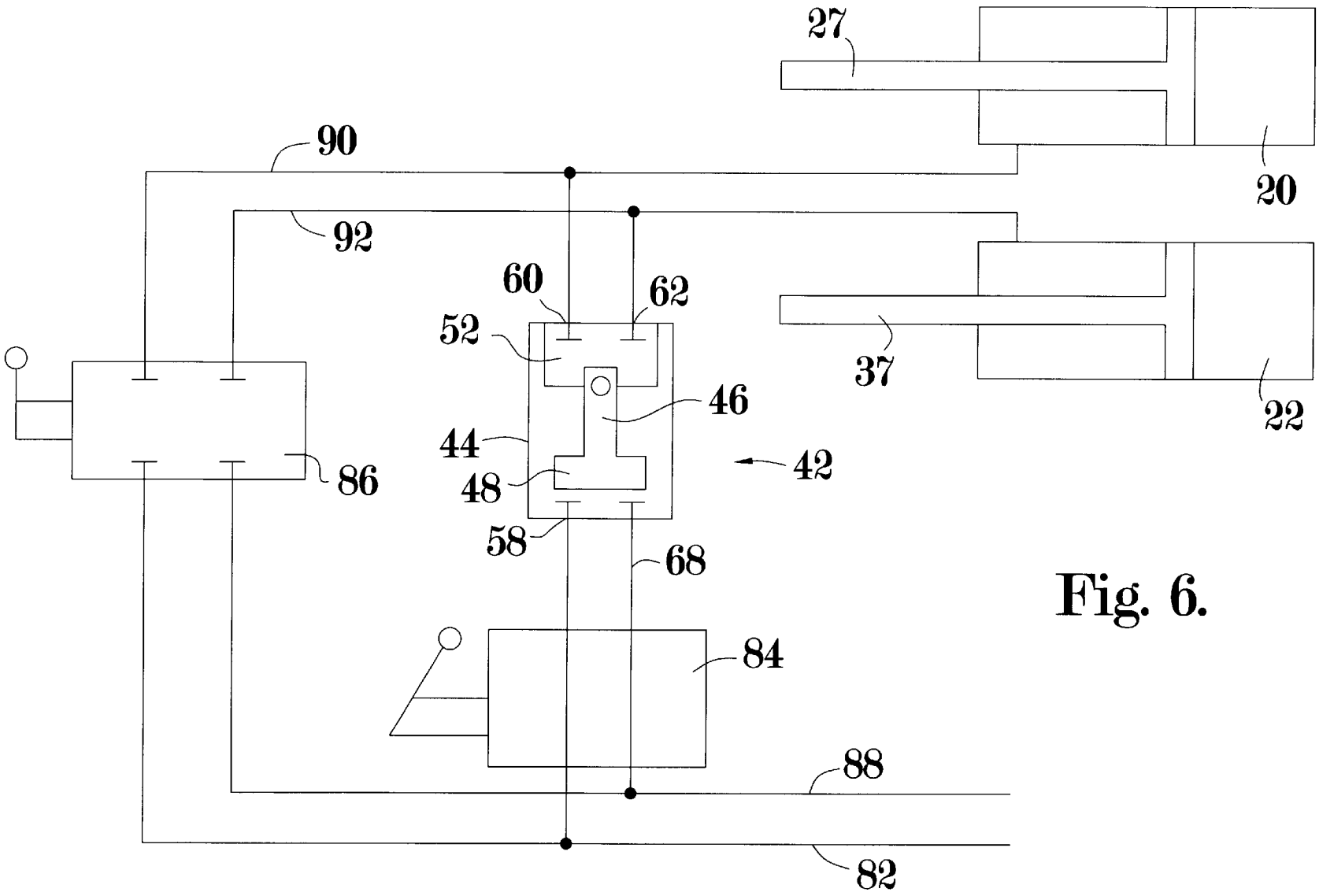
FIG. 6 is a schematic circuit diagram of the hydraulic circuit for the platform leveling system.

FIG. 6 depicts additional details of the hydraulic circuit which controls operation of the cylinders 20 and 22. A pressure line 82 extends both to a selector valve 84 and to a manual tilt valve 86. The selector valve 84 has an automatic position which is shown and which connects line 82 through the valve with the pressure port 58. In the automatic setting of the selector valve 84, line 68 connects through the valve with another line 88 which extends to the fluid reservoir 70. The selector valve can be shifted to a manual position in which the automatic leveling function is disabled and the platform orientation is controlled by the tilt valve 86. When the selector valve 84 is shifted to the manual position, it blocks the connection otherwise established between line 82 and port 58 and between the two lines 68 and 88.

The manual tilt valve 86 is in the off position shown during operation in the automatic leveling mode. Then, valve 86 blocks lines 82 and 88 from a pair of fluid lines 90 and 92 which lead to the rod ends of the respective cylinders 20 and 22. Valve 86 can be shifted to a tilt position in which line 82 is connected through valve 86 with line 90 and lines 88 and 92 are connected. This causes cylinder 20 to retract and tilts the platform 12 in order to dump debris from the platform or for rescuing occupants of the platform. Valve 86 also has a store position in which line 82 is connected with line 92 and lines 88 and 90 are connected, thus tilting the platform to a storage position.

The hydraulic circuit for the aerial device as a whole is depicted diagrammatically in FIG. 4. A pump 94 connects on its suction side with the fluid reservoir 70 and on its discharge side with a selector and outrigger valve 96. Valve 96 is used to control outriggers (not shown) which serve to stabilize the machine during operation, and it also has a discharge side which connects with a pressure reducing valve 98 and with a blocking valve 100. The blocking valve 100 is controlled by a pilot line 102 such that operating pressure through a boom function valve 104 for the boom lift cylinder 105 is available only if the pilot line 102 is activated with fluid pressure. Similarly, fluid pressure is blocked to the pressure line 82 for the platform leveling system unless the blocking valve 100 is open due to pressure in the pilot line 102.

The pressure reducing valve 98 reduces the fluid pressure on its discharge line 106 to a level of approximately 350 psi. Line 106 connects through an emergency stop valve 108 and through an interlock valve 110 with the pilot line 102 for the blocking valve 100. Consequently, both the emergency stop valve 108 and the interlock valve 110 must be open in order to activate the pilot line 102.

As shown in FIG. 1, the selector valve 84, the emergency stop valve 108, and the interlock valve 110 are mounted on one of the walls 14 of the platform 10 along with other components and controls. The operation of the boom is controlled by workers stationed in the platform 10 through a boom operating control handle 112 which can be operated to rotate the boom and to raise and lower it for the desired positioning of the platform. The control handle 112 is located near the upper edge of the platform on the same wall 14 as the selector valve 84, the emergency stop valve 108, and interlock valve 110.

Referring again to FIG. 4, the interlock valve 110 is controlled by a trigger 114 which is a safety control located adjacent to the control handle 112. The interlock valve 110 is normally in a closed position where it blocks pressure transmission from line 106 to line 102. In order to operate the boom, the control handle 112 is operated by hand, and the trigger 114 is pivoted at the same time to open the interlock valve 110 through a control cable 116 which extends from the trigger 114 to the interlock valve 110.

When the trigger is operated, valve 110 opens to apply pilot pressure to line 102 which opens the blocking valve 100, thus making fluid pressure available to the boom function valve 104 and boom cylinder 105, and to the pressure line 82 for the automatic leveling system. The boom function valve 104 is operated from the control handle 112 through pressure reducing valves 118.

In operation, the worker or workers stationed on the platform 10 make use of the control handle 112 to rotatively and vertically position the boom as desired to carry out their work. In order to operate the control handle 112, the trigger 114 must first be released in order to move the interlock valve 110 to the open position and allow pilot pressure to operate the blocking valve 100 through the pilot line 102. Consequently, only when the boom is being moved is pressure available to the pressure line 82 in order to activate the platform leveling system. Otherwise, the blocking valve 100 prevents fluid pressure from reaching the hydraulic valve housing 52 and the cylinders 20 and 22.

This feature enhances the safety of the machine. If the boom is stationary and workers are carrying out work, there is no need for the leveling system to be active. If the system were to be active at this time and should somehow malfunction to improperly tip the platform, the workers could be endangered. If, during operation of the boom through use of the control handle 112, the leveling system should somehow malfunction and begin tilting the platform, the control handle 112 can simply be released along with the trigger 114 in order to effect closing of the interlock valve 110 and immediate deactivation of the platform leveling system. The emergency stop valve 108 can also be activated to achieve the same result.

When the platform leveling system is active during movement of the boom, the gravity sensing means provided by the pendulum 48 senses when the platform deviates from a level position and acts through the hydraulic valve 52 to automatically retract the appropriate cylinder 20 or 22 to correct the out of level condition. Deviation from a level position results in displacement of the valve element 54 either to the position shown in FIG. 5 where the fluid connection of ports 58 and 62 through notch 76 provides a fluid signal which effects retraction of cylinder 22, or to another position in the opposite direction where port 58 connects through notch 76 with port 60 to provide a fluid signal which effects retraction of cylinder 20. Thus, one fluid signal rotates the platform in one direction and the other fluid signal rotates the platform in the opposite direction; in each case, the direction of platform rotation is proper to correct the deviation from a level position.

The selector valve 84 is in the automatic setting and the manual tilt valve 86 is in the off position during normal operation of the machine in the automatic leveling mode. In order to store the platform 10 when it is not being used or to tilt it in order to dump debris from the platform or during a rescue operation, the selector valve 84 is shifted to the manual position wherein it blocks fluid flow from the pressure line 82 to the pressure port 58 of the hydraulic valve 52. The tilt valve 86 can then be shifted to the tilt position or to the storage position to effect retraction of one of the cylinders 20 or 22 in order to tilt the platform in the desired direction.

The use of the hydraulic cylinders 20 and 22 in combination with the "walking link" arrangement provided by the flexibly connected links 28 and 38 allows a large degree of boom articulation and also provides the smooth and positive operational feel associated with hydraulic cylinders. The relatively small "breakaway friction" force associated with hydraulic cylinders provides smoother operation of the system than rotary actuators or motor/gear box actuators. At the same time, the limitations of chain or cable leveling systems and master/slave hydraulic systems are not encountered.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

Having thus described the invention, what is claimed is:

1. A platform leveling system comprising:

an elongate boom movable in plural operating modes;

an aerial work platform having a platform pin mounted on said boom for pivotal movement of said platform about a substantially horizontal axis;

an extensible and retractable power operated linear actuator having first and second ends, said first end being connected with the boom;

a lever coupled with the platform in a manner to pivot the platform about said axis in opposite directions when the lever is moved in opposition directions, said second end of the actuator being connected to said lever to move the lever in opposite directions as the actuator extends and retracts;

means for sensing the position of the platform relative to a level position, said sensing means providing a first signal when the platform deviates from a level position in one direction about said axis and a second signal when the platform deviates from a level position in the other directions about said axis;

means for applying power to said actuator in a manner to effect extension of said actuator in response to said first signal and retraction of said actuator in response to said second signal, thereby maintaining the platform in a substantially level position; and means for automatically preventing the application of power to said actuator unless the boom is moving in one of said plural operating modes.

2. A system as set forth in claim 1, wherein said sensing means comprises gravity operated means.

3. A system as set forth in claim 1, wherein said sensing means comprises:

a pendulum mounted on the platform for free pivotal movement about a pendulum axis substantially parallel to said substantially horizontal axis; and a valve pivotal with said pendulum about said pendulum axis, said valve receiving fluid pressure and providing said first and second signals in the form of fluid pressures when the platform deviates from a level position.

4. A system as set forth in claim 1, wherein the platform has a control for controlling operation of the boom in plural operating modes when the control is activated, said means for automatically preventing the application of power acting to prevent the application of power to said actuator unless said control is activated.

5. A platform leveling system comprising:

an elongate boom;

an aerial work platform having a platform pin mounted on said boom for pivotal movement about a substantially horizontal axis;

first and second extensible and retractable power operated linear actuators having first and second ends, said first ends being connected with the boom;

a drum connected with said platform pin and having a substantially cylindrical surface centered on said axis;

first and second levers extending from said drum at locations offset from one another along the drum axis;

two sets of links each including a plurality of links flexibly coupled together, said two sets of links being disconnected from each other and being connected with the second ends of the respective actuators, said links in the two sets being connected with the respective first and second levers and extending on said cylindrical surface thereof in opposite directions, said links on said cylindrical surface applying force at a substantially constant radius from the center of said drum;

level sensing means for sensing the orientation of the platform and providing first and second signals when the platform deviates from a level position in opposite directions about said axis; and means for applying power to said actuators in a manner to effect retraction of said first and second actuators to pivot the platform about said axis in opposite directions in response to the respective first and second signals, thereby maintaining the platform in a substantially level position.

6. A leveling system as set forth in claim 5, including:

means for selectively disabling said means for applying power to said actuators; and means for tilting the platform about said axis to a preselected tilted position displaced from a level position when said means for applying power to said actuators is disabled.

7. A leveling system as set forth in claim 5, wherein the platform has a control for controlling operation of the boom in plural operating modes when the control is activated, and including means for disabling said means for applying power to said actuators unless said control is activated.

8. A leveling system for an aerial platform mounted on an aerial boom for pivotal movement about a substantially horizontal axis and having a control for effecting operation of the boom in plural operating modes when the control is activated, said system comprising:

level sensing means for providing first and second signals when the platform deviates from a level position in opposite directions about said axis;

means responsive to said signals for effecting pivotal movement of the platform about said axis in one direction in response to said first signal and in the opposite direction in response to said second signal, thereby maintaining the platform in a substantially level position; and means for automatically disabling said means responsive to said signals unless said control is activated to effect operation of the boom.

9. A system as set forth in claim 8, wherein said means responsive to said signals comprises:

a platform pin arranged coaxially with said axis for mounting the platform on the boom;

a drum connected with said platform pin and having a substantially cylindrical surface centered on said axis;

a pair of extensible and retractable linear actuators each having one end connected with said boom and another end equipped with a plurality of flexibly coupled links wrapped on and connected with said drum, the links on said actuators being wrapped on the drum in opposite directions; and means for applying power in a manner to retract one of said actuators in response to said first signal and to retract the other actuator in response to said second signal, said actuators upon retraction turning the platform pin in opposite directions to maintain the platform in a substantially level position.

* * * * *